US007576699B2

(12) United States Patent
Gilmore et al.

(10) Patent No.: US 7,576,699 B2
(45) Date of Patent: Aug. 18, 2009

(54) MOBILE PHONE HAVING A DIRECTED BEAM ANTENNA

(75) Inventors: Robert P. Gilmore, Poway, CA (US); Insung Kang, San Diego, CA (US)

(73) Assignee: Via Telecom Co., Ltd., Grand Cayman (KY)

( * ) Notice: Subject to any disclaimer, the term of this patent is extended or adjusted under 35 U.S.C. 154(b) by 0 days.

(21) Appl. No.: 11/703,426

(22) Filed: Feb. 6, 2007

(65) Prior Publication Data

US 2007/0159404 A1 Jul. 12, 2007

Related U.S. Application Data

(62) Division of application No. 11/051,443, filed on Feb. 3, 2005, now Pat. No. 7,199,760.

(51) Int. Cl.
*H01Q 1/24* (2006.01)

(52) U.S. Cl. ..... 343/702; 343/810

(58) Field of Classification Search ..... 343/702, 343/810, 793, 900, 901
See application file for complete search history.

(56) References Cited

U.S. PATENT DOCUMENTS

| | | | | |
|---|---|---|---|---|
| 5,389,938 | A * | 2/1995 | Harrison | 343/702 |
| 6,392,610 | B1 * | 5/2002 | Braun et al. | 343/876 |
| 6,563,467 | B1 * | 5/2003 | Buris et al. | 343/702 |
| 6,781,556 | B2 * | 8/2004 | Kojima et al. | 343/818 |
| 6,844,854 | B2 * | 1/2005 | Johnson et al. | 343/702 |
| 6,856,819 | B2 * | 2/2005 | Itoh | 455/575.7 |
| 6,888,504 | B2 * | 5/2005 | Chiang et al. | 343/702 |
| 6,985,113 | B2 * | 1/2006 | Nishimura et al. | 343/702 |
| 7,002,518 | B2 * | 2/2006 | Lin et al. | 343/700 MS |
| 7,154,442 | B2 * | 12/2006 | van Wonterghem et al. | 343/702 |
| 7,343,183 | B2 * | 3/2008 | Iguchi | 455/575.7 |
| 2002/0033775 | A1 * | 3/2002 | Ha et al. | 343/702 |
| 2004/0021608 | A1 * | 2/2004 | Kojima et al. | 343/702 |
| 2004/0032370 | A1 * | 2/2004 | Ito et al. | 343/702 |
| 2004/0130492 | A1 * | 7/2004 | Egawa et al. | 343/702 |
| 2004/0227675 | A1 * | 11/2004 | Harano | 343/702 |
| 2006/0017624 | A1 * | 1/2006 | Nagano et al. | 343/702 |
| 2007/0152893 | A1 * | 7/2007 | Chiang et al. | 343/702 |

OTHER PUBLICATIONS

Hansen, Markus, "A Portable 2-Element Triband Yagi," QST, Nov. 2001, p. 36.

Kraus, John D., "Antennas" 2nd Edition, 1988, McGraw-Hill, Inc., p. 472.

"The ARRL Antenna Book," 18th Edition, 1999, The American Radio Relay League, pp. 11-2, 11-9 to 11-21.

* cited by examiner

*Primary Examiner*—HoangAnh T Le
(74) *Attorney, Agent, or Firm*—K & L Gates LLP

(57) ABSTRACT

A mobile phone includes a body and an antenna array that is coupled to the body.

12 Claims, 6 Drawing Sheets

MOBILE PHONE HAVING A DIRECTED BEAM ANTENNA

RELATE BACK INFORMATION

This application is a divisional of U.S. application Ser. No. 11/051,443 filed on Feb. 3, 2005 now U.S. Pat. No. 7,199,760, herein incorporated by reference.

FIELD OF THE INVENTION

The present invention relates to mobile phones, and more particularly to a mobile phone having a directed beam antenna.

BACKGROUND OF THE INVENTION

Mobile phones typically use whip or helix antennas, which have hemispherical coverage patterns. With a hemispherical pattern, the mobile phone may be oriented anywhere in azimuth with respect to the cell site without affecting reception, assuming no blocking objects are present.

One disadvantage of conventional mobile phones is that the antenna radiates electromagnetic energy into a user's head equally compared to other angles. Antenna design must be carefully managed in order to comply with Specific Absorption Rate (SAR) specifications, which limit the amount of electromagnetic energy a user's head may receive.

Another disadvantage is that gain in the direction of a user's head is diminished because of blockage by the head. The energy directed into the head makes it difficult to meet SAR requirements, and is to some degree wasted because it is blocked by the head. Conventional designs employ an external whip antenna and/or an external helical antenna that each has hemispherical coverage. Some mobile phones use internal antennas such as the Inverted-F type or microstrip designs such as a patch or parasitic patch, which have hemispherical patterns or a dipole-like pattern as illustrated in FIG. 1. FIG. 1 also illustrates an external helical antenna.

FIG. 1 is a diagram illustrating a front view of a conventional mobile phone 10 with an electromagnetic pattern 12 from a center-fed dipole 14 located inside the mobile phone 10. The dipole 14 has a length of approximately L/2, where L is the length of one electromagnetic wave at the frequency at which the dipole 14 operates.

FIG. 2 is a diagram illustrating a side view of the conventional mobile phone 10 with the electromagnetic pattern 12 from the dipole 14. Electromagnetic pattern 12 has a null, but in order to align that null with a user's head during operation the dipole 14 would have to be rotated 90 degrees. At the frequencies typically used with mobile phones, a mobile phone housing such a rotated dipole would be very thick.

Accordingly, what is needed is a mobile phone having a directed beam antenna that assists in meeting SAR specifications, reduces wasted energy towards a user's head, and increases energy in other directions. The present invention addresses such a need.

BRIEF SUMMARY OF THE INVENTION

The present invention provides a mobile phone including a body and an array antenna that is coupled to the body.

According to a method and system disclosed herein, the present invention takes advantage of the three dimensions in a mobile phone to implement a directed beam antenna, for example a Yagi antenna, also known as Yagi or a Yagi-Uda array. The Yagi antenna includes two or more parallel dipoles aligned within the body of a mobile phone to direct energy away from the user, taking advantage of the three dimensions by placing each dipole at a different distance from the front (or back) of the phone. Selecting appropriate lengths for each of the dipoles also assists in directing the energy away from the user's head during normal use.

DETAILED DESCRIPTION OF THE INVENTION

The present invention relates to mobile phones, and more particularly to a mobile phone having a directed beam antenna. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 3:
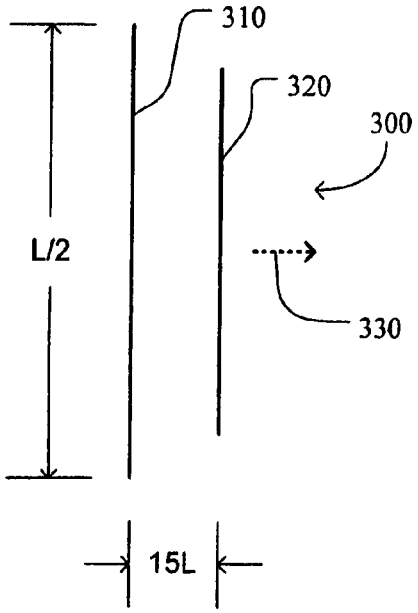
FIG. 3 is a diagram illustrating a two-element antenna array.

FIG. 3 is a diagram illustrating one embodiment of the invention implemented in a two-element antenna array 300 (array 300), or an array of stacked dipoles, slots, monopoles, patches, parasitic elements, etc. The antenna is an array of elements positioned and sized to achieve directivity and consequently gain. One example of an antenna array is a Yagi antenna, or Yagi array. Antenna array 300 includes a driven element 310 and a passive (or parasitic) element, or a director 320. The driven element 310 typically has a length of approximately L/2, where L is the wavelength of the signal the array 300 is intended to receive. For example, with a communication frequency of 850 MHz, L/2 is approximately 3.1 inches, while L/2 at 1900 MHz is approximately 1.4 inches. The driven element 310 may be a center-fed dipole, or the equivalent of a center-fed, half-wave dipole antenna. The driven element 310 typically is electrically coupled to circuitry in the mobile phone.

Figure 1:
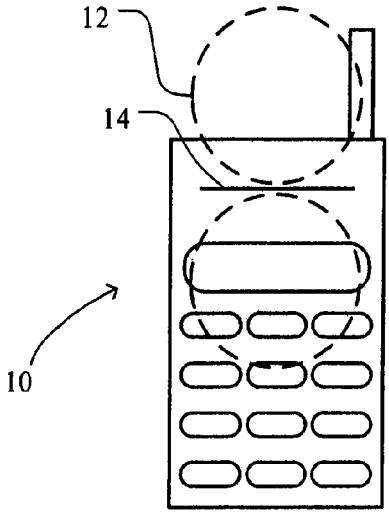
FIG. 1 Prior Art
FIG. 1 is a diagram illustrating a front view of a conventional mobile phone with the electromagnetic pattern from a center-fed dipole.
Figure 2:
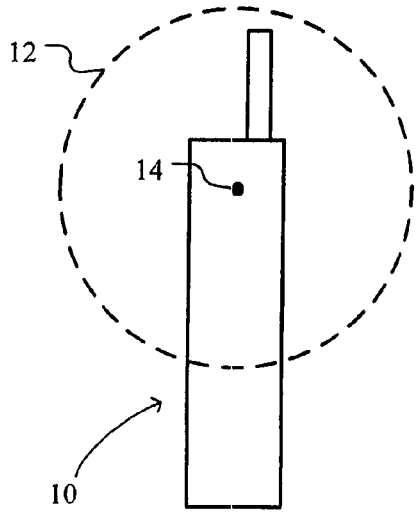
FIG. 2 Prior Art
FIG. 2 is a diagram illustrating a side view of a conventional mobile phone with an electromagnetic pattern from a center-fed dipole.
Figure 4:
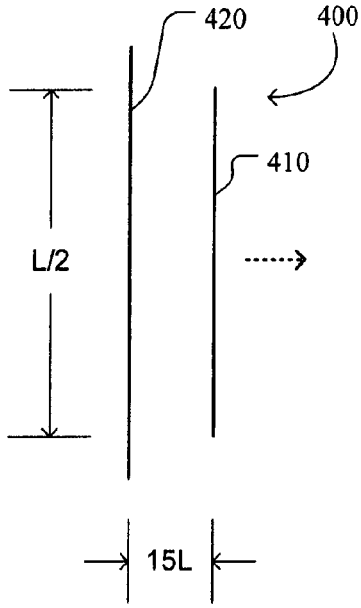
FIG. 4 is a diagram illustrating a two-element antenna array.
Figure 5:
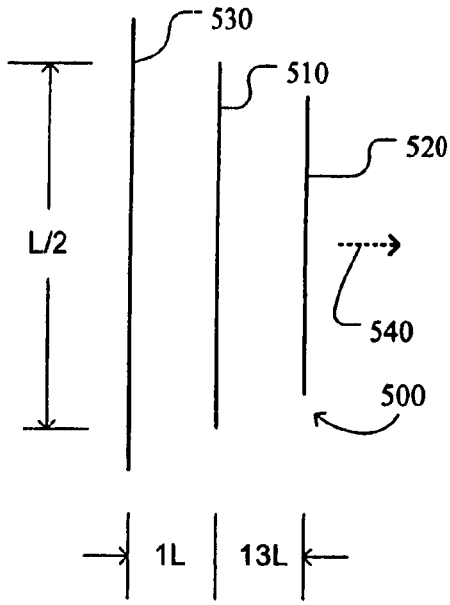
FIG. 5 is a diagram illustrating a three-element antenna array.

The director 320 typically has a length slightly shorter than the driven element 310. FIGS. 3, 4, and 5 provide one example of elements scaled according to actual designs. The driven element 310 and the director 320 may be separated by 0.15 L in one embodiment and up to about 0.5 L (as a guideline, not a limitation). The driven element 310 radiates a signal that is directed, or focused, by director 320. Energy is directed from the driven element 310 to the director 320, in the direction of arrow 330.

The driven and passive elements in an array antenna may be any conducting material, for example wires, cylinders, and printed traces, and the dimensions may be reduced, for example by folding the dipoles (each element may be a dipole) and/or using dielectrics. Alternatively or in addition to the array antenna, two driven elements, each with a length of approximately L/2, may be used as stacked dipoles. Also, the array may be used in multi-band operation, using tuning, traps, and other multi-band techniques.

FIG. 4 is a diagram illustrating another embodiment of the invention implemented in a two-element array 400. Array 400 includes a driven element 410 and a passive element, or a reflector 420. The driven element 410 typically has a length of approximately L/2, where L is the wavelength of the signal the array 400 is intended to receive. The driven element 410 may be a center-fed dipole, or the equivalent of a center-fed, half-wave dipole antenna.

The reflector 420 typically has a length slightly longer than the driven element 410. The driven element 410 and the reflector 420 may be separated by 0.15 L in one embodiment and up to about 0.5 L (as a guideline, not a limitation). The driven element 410 radiates a signal that is reflected by reflector 420. Energy is reflected from the reflector 420 back to the driven element 410, or towards the right in FIG. 4.

FIG. 5 is a diagram illustrating one embodiment of the invention implemented in a three-element array 500. Array 500 includes a driven element 510 and two passive elements, a director 520 and a reflector 530. The driven element 510 typically has a length of approximately L/2, where L is the wavelength of the signal the array 500 is intended to receive or transmit. The driven element 510 may be a center-fed dipole, or the equivalent of a center-fed, half-wave dipole antenna.

The director 520 typically has a length slightly shorter than the driven element 510. In array 500, the driven element 510 and the director 520 may be separated by 0.13 L in one embodiment and up to about 0.5 L (as a guideline, not a limitation). The driven element 510 radiates a signal that is directed, or focused, by director 520.

The reflector 530 typically has a length slightly longer than the driven element 510. The driven element 510 and the reflector 530 may be separated by 0.1 L in one embodiment and up to about 0.5 L (as a guideline, not a limitation). The driven element 510 radiates a signal that is reflected by reflector 530. Energy is reflected by reflector 530 and directed from the driven element 510 to the director 520, in the direction of arrow 540. Advantages of an array antenna include a directional radiation and response pattern, with a corresponding gain in the radiation and response.

In another embodiment, an array antenna may be configured with more than three total elements, for example a driven element and multiple directors with no reflector, or in other configurations.

Figure 6:
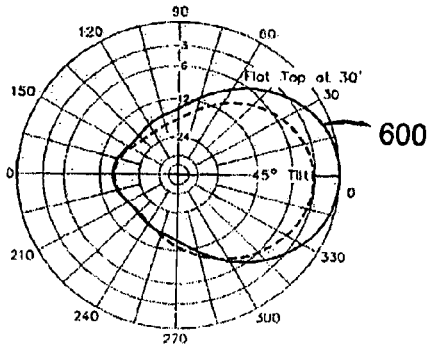
FIG. 6 is a diagram illustrating a radiation pattern for a two-element antenna array.

FIG. 6 is a diagram illustrating a radiation pattern for a two-element array antenna. Pattern 600 is focused and directed along the 0 degree axis of an array antenna, or towards the right direction of FIGS. 3-5. A two-element array antenna, for example array 300 or 400 from FIG. 4 or FIG. 5, has a gain of 5-6 dBi over an isotropic antenna.

Figure 7:
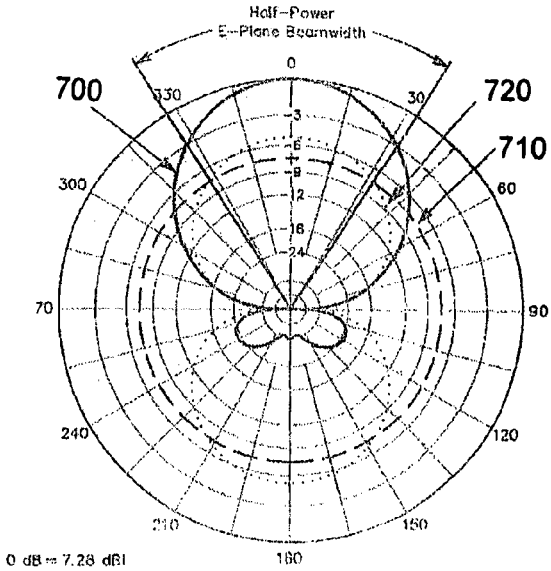
FIG. 7 is a diagram illustrating a radiation pattern for a three-element antenna array.

FIG. 7 is a diagram illustrating a radiation pattern for a three-element array antenna. Pattern 700 is focused and directed along the 0 degree axis of an array antenna, or towards the right in FIGS. 3-5. In comparison, pattern 710 represents an isotropic pattern while pattern 720 represents a dipole pattern. A three-element array antenna, for example array 500 from FIG. 5, has a gain of 6-8 dBi over a conventional isotropic antenna. The more directors an array antenna has, the greater the forward gain. With respect to both pattern 600 from FIG. 6 and pattern 700 from FIG. 7, the energy is focused and directed from the driven element to the director, or away from the reflector, or both. By positioning the driven element and one or more passive elements in a mobile phone, energy may be directed away from a user's head, assisting in the SAR requirements and improving reception from certain angles. Because phones are being made smaller, their antennas do not extend above a user's head. Also, in a clamshell design, the antenna is situated near the middle of the phone and not at the top of the phone. Given that the beam from a non-directional antenna is blocked in one direction by the user's head, energy in that direction tends to be wasted.

Figure 8:
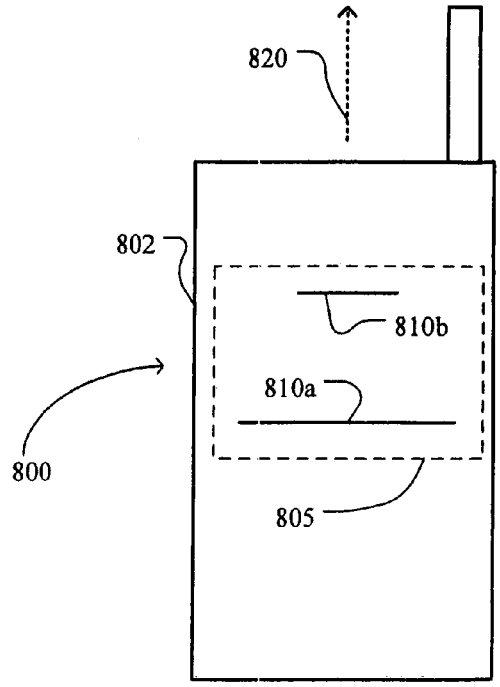
FIG. 8 is a diagram illustrating a front view of one embodiment of the invention in a mobile phone.

FIG. 8 is a diagram illustrating a front view of one embodiment of the invention in a mobile phone 800. The body 802 of mobile phone 800 holds an array 805 that includes elements 810*a* and 810*b*, collectively referred to as 810. In one embodiment, assume element 810*a* is a driven element. Element 810*a* may be approximately L/2 in length (disregarding techniques and tuning for decreasing dipole length), with element 810*b* as a passive element, in this case a director. The array 805 may be located inside of body 802. FIG. 3 represents one embodiment of a driven element/director configuration upon which the array 805 may be modeled.

In another embodiment, assume element 810*a* is a passive element, or a reflector. Element 810*b* may be a driven element approximately U2 in length (disregarding techniques and tuning for decreasing dipole length). FIG. 4 represents one embodiment of a driven element/reflector configuration upon which the array 805 of FIG. 8 may be modeled.

In both of the above embodiments, the energy from the array 805 is directed upward, as indicated by arrow 820.

Figure 9:
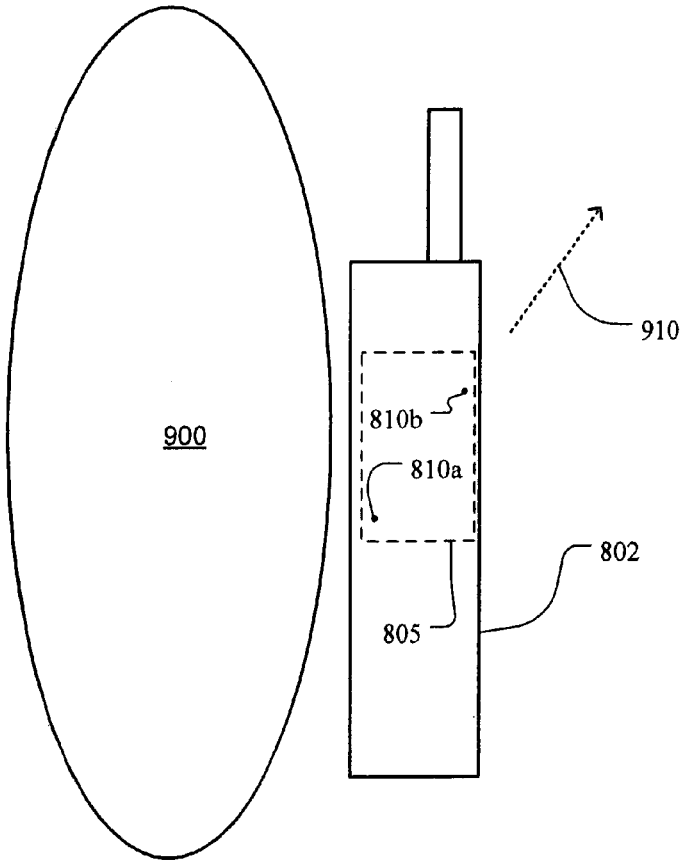
FIG. 9 is a diagram illustrating a side view of one embodiment of the invention in the mobile phone from FIG. 8.

FIG. 9 is a diagram illustrating a side view of the embodiment of the invention in the mobile phone from FIG. 8. In this embodiment, element 810*a* is closer to the front of body 802, or closer to the area that a user's head 900 would typically occupy during use. Element 810*b* is further from the front, or closer to the back of the body 802 of mobile phone 800. Only the end view of a wire or rod is illustrated for elements 810 in FIG. 9.

With either element 810*a* as a driven element and element 810*b* as a director, or element 810*a* as a reflector and element 810*b* as a driven element, the energy from array 805 is directed along arrow 910, which is away from user's head 900 during operation. Elements 810 form a line through arrow 910, indicating the direction in which radiation from array 805 is concentrated, assuming the director/reflector/driven element arrangement described above. By tilting the array 805 within the body 802, energy can be directed and focused away from the user. Some energy is still directed toward the user's head 900 (see FIGS. 6 and 7), but the majority of the energy is directed away from the user's head 900. The driven element may be located on a circuit board (not shown), for example, while the passive element may be located somewhere on the body 802. Many variations on the positioning of array 805 are available.

Figure 15:
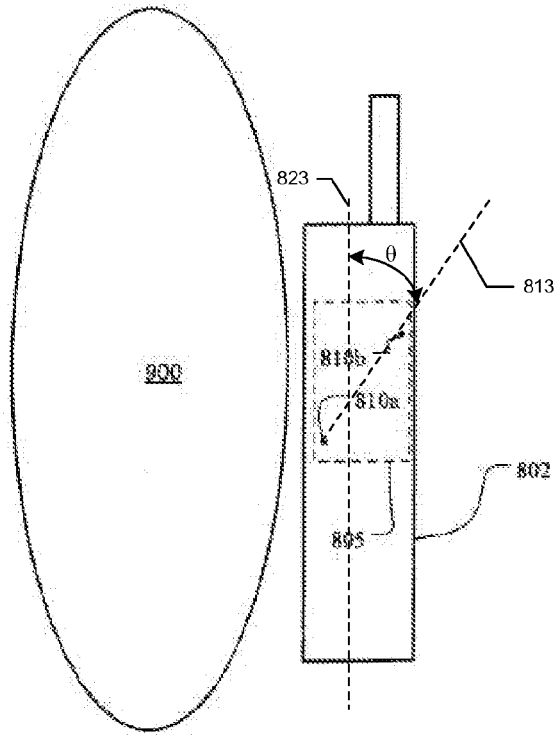
FIG. 15 is a diagram illustrating a mobile phone with an antenna array comprising two elements that form a plane at an angle to the plane formed by the body of the mobile phone according to one embodiment.

With either element 810*a* as a driven element and element 810*b* as a director, or element 810*a* as a reflector and element 810*b* as a driven element, the energy from array 805 is directed along arrow 910, which is away from user's head 900 during operation. Elements 810 form a line through arrow 910, indicating the direction in which radiation from array 805 is concentrated, assuming the director/reflector/driven element arrangement described above. By tilting the array 805 within the body 802, energy can be directed and focused away from the user. As shown in FIG. 15, the elements 810*a* and 810*b* are coplanar, with the plane 813 of the elements 810*a*, 810*b* forming a non-zero angle θ to the horizontal plane 823 formed by the body 802. Some energy is still directed toward the user's head 900 (see FIGS. 6 and 7), but the majority of the energy is directed away from the user's head 900. The driven element may be located on a circuit board (not shown), for example, while the passive element may be located somewhere on the body 802. Many variations on the positioning of array 805 are available.

In another embodiment, assume elements 1010*a* and 1010*b* are passive elements, or directors. Element 1010*c* may be a driven element approximately L/2 in length (disregarding techniques and tuning for decreasing dipole length).

In both of the above embodiments, the energy from the array 1005 is directed towards the left, as indicated by arrow 1020. Furthermore, in both of the above embodiments, element 1010*c* may function as a part of the array 1005 while in the down, or retracted position, and as a whip antenna while in the up, or extended position (see FIG. 12). The whip may extend above the head, so energy is above the head. In conventional systems, when the whip is retracted, the internal antenna is no longer above the head so energy is directed toward the head. According to the invention, for SAR and gain reasons it is therefore advantageous for the internal antenna to direct energy away from the head.

Figure 10:
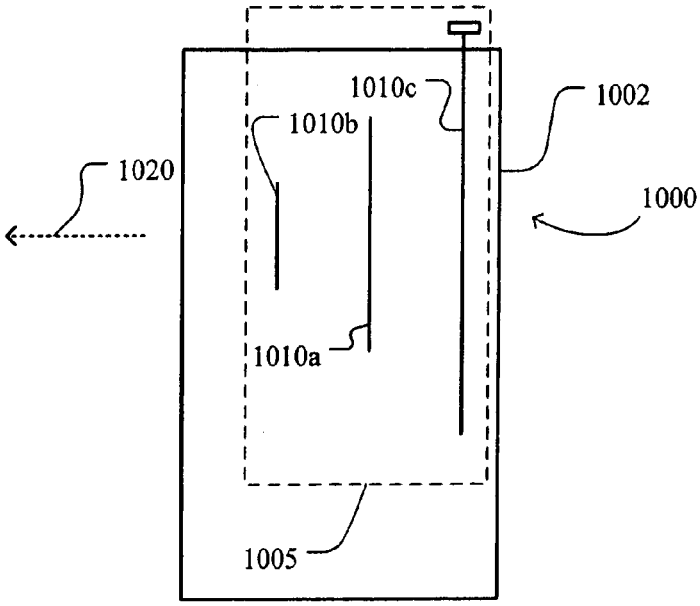
FIG. 10 is a diagram illustrating a front view of one embodiment of the invention in a mobile phone.
Figure 11:
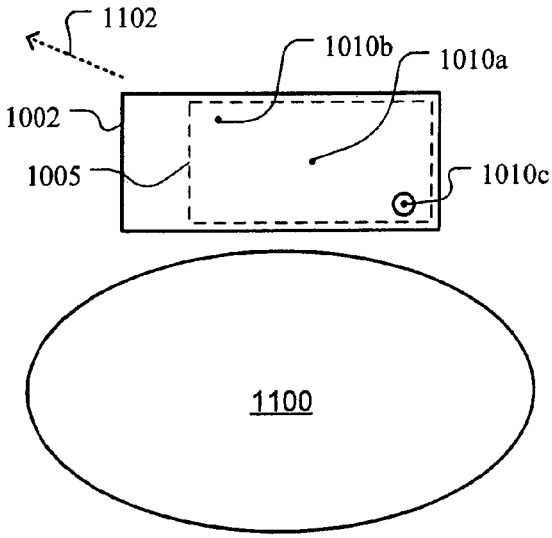
FIG. 11 is a diagram illustrating a plan view of the embodiment of the invention in the mobile phone from FIG. 10.

FIG. 11 is a diagram illustrating a plan view of the embodiment of the invention in the mobile phone 1000 from FIG. 10. In this embodiment, element 1010*c* is closer to the front of body 1002, or closer to the area that a user's head 1100 would typically occupy during use. Element 1010*b* is further from the front, or closer to the back of the body 1002 of mobile phone 1000. Element 1010*a* is in between elements 1010*b* and 1010*c*. Only the end view of a wire or rod is illustrated for elements 1010 in FIG. 11.

With either element 1010*a* as a driven element and element 1010*b* as a director and element 1010*c* as a reflector, or element 1010*c* as a driven element and elements 1010*a* and 1010*b* as directors, the energy from array 1005 is directed along arrow 1102, which is away from user's head 1100 during operation. Elements 1010 form a line through arrow 1102, indicating the direction in which radiation from array 1005 is concentrated, assuming the director/reflector/driven element arrangement described above.

By tilting the array 1005 within the body 1002, energy can be directed and focused away from the user. Some energy is still directed toward the user's head 1100 (see FIGS. 6 and 7), but the majority of the energy is directed away. The driven element may be located on a circuit board (not shown), form example, while the passive elements may be located somewhere on the body 1002. Many variations on the positioning of array 1005.are available.

Figure 12:
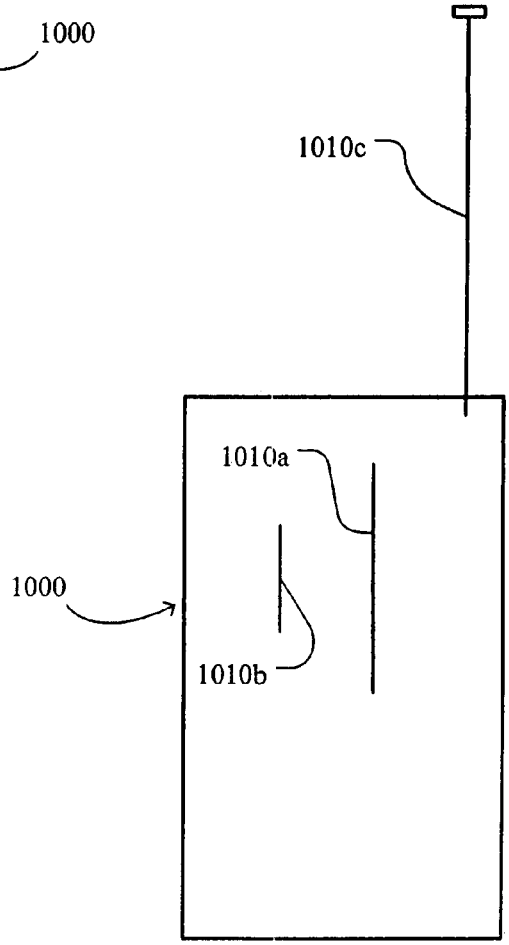
FIG. 12 is a diagram illustrating a front view of one embodiment of the invention in the mobile phone from FIG. 10.

FIG. 12 is a diagram illustrating a front view of one embodiment of the invention in the mobile phone 1000 from FIG. 10. Element 1010*c* is extended from the body 1002 and a mechanism (not shown) has deactivated the array antenna and is instead applying element 1010*c* as a whip antenna, providing the benefits of a whip antenna while extended and the benefits of an array antenna while retracted. A separate whip antenna may be provided and used aside from an array antenna (having no overlapping parts).

Figure 14:
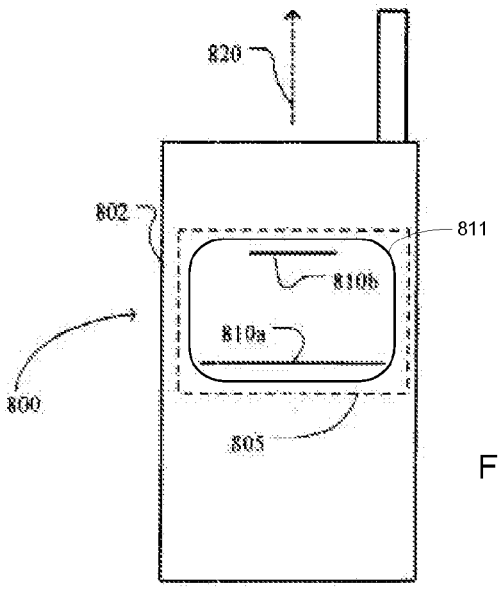
FIG. 14 is a diagram illustrating a mobile phone with a loop antenna according to one embodiment.

In another embodiment, the configurations of the array antenna in FIGS. 8, 9, 10, and 11 may be combined in order to provide two antennas with directional beams that are orthogonally polarized. Two-or-more-element array antennas may be combined for diversity. Additionally, a loop antenna 811 may be added around the periphery of the circuit board or the body to provide spatial and/or polarization diversity, as shown in FIG. 14.

Figure 13:
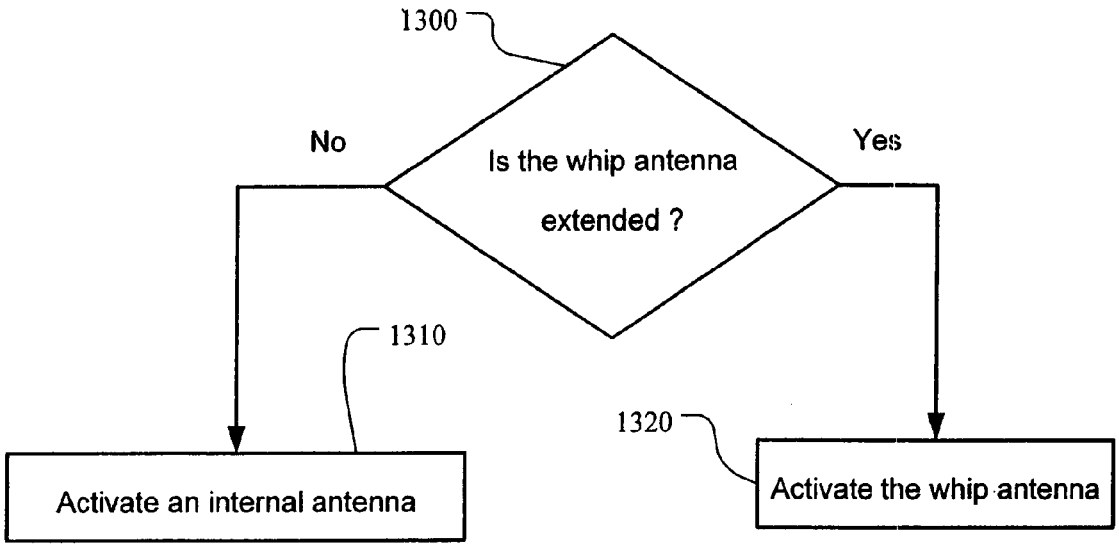
FIG. 13 is a flow diagram illustrating one method of implementing the invention with the mobile phone from FIG. 10.

FIG. 13 is a flow diagram illustrating one method of implementing the invention with the mobile phone 1000 from FIG. 10. In block 1300, mobile phone 1000 determines if element 1010*c*, which is also a whip antenna, is extended (or alternatively, retracted). A switch, lever, or other mechanism may be used (not shown).

If the element 1010*c* is not extended, then in block 1310 the mobile phone 1000 activates an internal antenna, for example array 1005.

If the element 1010*c*, is extended, then in block 1320 the mobile phone 1000 activates element 1010*c* as the whip antenna.

Radiation towards the users head may be reduced by activating the array antenna when the whip is down, and performance may be increased.

According to the method and system disclosed herein, the present invention provides a mobile phone with a directed beam antenna. The present invention has been described in accordance with the embodiments shown, and one of ordinary skill in the art will readily recognize that there could be variations to the embodiments, and any variations would be within the spirit and scope of the present invention. Furthermore, the preceding Figures are not drawn to scale. Accordingly, many modifications may be made by one of ordinary skill in the art without departing from the spirit and scope of the appended claims.

We claim:

1. A mobile phone comprising:

a body;

an antenna array coupled to the body, wherein the antenna array comprises at least one driven antenna element and at least one passive antenna element, and wherein the at least one driven antenna element is within the body; and a retractable antenna element, wherein the retractable antenna element is used as a whip antenna while in an extended position and is configured to function as an antenna element cooperating with the antenna array while in a retracted position.

2. The mobile phone of claim 1, the body having a substantially rectangular shape and the driven and passive antenna elements form a plane at an angle to the plane formed by the body.

3. The mobile phone of claim 2, wherein the antenna array is configured to direct a majority of electromagnetic energy away from a user during operation.

4. The mobile phone of claim 3 further comprising: a loop antenna coupled to the body and configured to generate a polarization pattern orthogonal to the polarization pattern of the antenna array.

5. The mobile phone of claim 1 further comprising:

a circuit board within the body, wherein the driven antenna element is on the circuit board and the passive antenna element is coupled to the body.

6. The mobile phone of claim 5, wherein the passive antenna element is selected from the group consisting of a metallic paint, a line of metal, a metal strip, and a wire.

7. The mobile phone of claim 5, the body having a front and a back wherein the front is nearer to a user's head during operation than the back, the circuit board positioned between the front and the back, and the passive antenna element further comprising a director positioned between the circuit board and the back.

8. The mobile phone of claim 7 wherein the director is shorter than the driven antenna element.

9. The mobile phone of claim 5, the body having a front and a back wherein the front is nearer to a user's head during operation than the back, the circuit board positioned between the front and the back, and the passive element further comprising a reflector positioned between the circuit board and the front.

10. The mobile phone of claim 9 wherein the reflector is longer than the driven antenna element.

11. The mobile phone of claim 1, further comprising a circuit board within the body, the body having a front and a back wherein the front is nearer to a user's head during operation than the back, the circuit board positioned between the front and the back, and wherein the antenna array comprises first and second passive antenna elements, wherein the driven antenna element is on the circuit board and the passive antenna elements are coupled to the body, wherein the first passive antenna element comprises a director positioned between the circuit board and the back, and a the second passive antenna element comprises a reflector positioned between the circuit board and the front.

12. The mobile phone of claim 11 wherein the director is shorter than the driven antenna element, and the reflector is longer than the driven antenna element.

* * * * *